US005752660A

United States Patent [19]

Steckly

[11] Patent Number: 5,752,660

[45] Date of Patent: May 19, 1998

[54] METHOD OF STOPPING LEAKAGE FROM A PLURALITY OF SPRINKLER HEADS FORMING PART OF A LIQUID PIPING NETWORK

[76] Inventor: Stephen Dale Steckly, 228 Rhatigan Road East, Edmonton, Alberta, Canada, T6R 1N7

[21] Appl. No.: 716,620

[22] Filed: Sep. 19, 1996

[51] Int. Cl.[6] ..... B05B 1/28

[52] U.S. Cl. ..... 239/120; 239/121; 239/124

[58] Field of Search ..... 239/104, 120, 239/121, 124; 141/115–117

[56] References Cited

U.S. PATENT DOCUMENTS

| | | | |
|---|---|---|---|
| 2,684,805 | 7/1954 | McBean | 141/116 |
| 4,797,098 | 1/1989 | Kawata | 141/116 |
| 5,437,316 | 8/1995 | McPherson | 141/115 |

*Primary Examiner*—Andres Kashnikow
*Assistant Examiner*—Lisa Ann Douglas
*Attorney, Agent, or Firm*—Anthony R. Lambert

[57] ABSTRACT

A method of stopping excessive leakage from sprinkler heads of a liquid piping network. Firstly, providing a backflow inducer housing divided by a flexible diaphragm into a first compartment on a first side of the diaphragm and a second compartment on a second side of the diaphragm. The relative volume of the first compartment and the second compartment change with the positioning of the diaphragm. A spring is provided in the first compartment to bias the diaphragm toward a backflow inducing position in which the volume of the first compartment is larger than the volume of the second compartment. Secondly, connecting a first inlet/outlet of the housing to a liquid piping network. Thirdly, connecting a second inlet/outlet of the housing to a source of pressurized working fluid. The diaphragm is moved by the pressurized working fluid toward an operational position in which the volume of the second compartment is larger than the volume of the first compartment. Fourthly, providing controls to exhaust the second compartment of the backflow inducer housing simultaneously with the termination of spraying. The diaphragm is rapidly moved to the backflow inducing position thereby drawing sufficient liquid from the liquid piping system to prevent excessive leakage of the sprinkler heads.

2 Claims, 2 Drawing Sheets

METHOD OF STOPPING LEAKAGE FROM A PLURALITY OF SPRINKLER HEADS FORMING PART OF A LIQUID PIPING NETWORK

FIELD OF THE INVENTION

The present invention relates to a method of stopping leakage from a plurality of sprinkler heads forming part of a liquid piping network.

BACKGROUND OF THE INVENTION

The most common form of liquid piping network equipped with a plurality of sprinkler heads is a fire sprinkler system for a building. Once open to the flow of liquid, these sprinkler heads are slow to close. This leakage goes unnoticed in a fire sprinkler application. Once a volume of liquid has been released to extinguish a fire, an additional cupful of liquid delivered through each sprinkler head is not a matter for concern. There are other applications, however, in which this leakage is undesirable. One example of such an application is in dust control for barns. In order to control dust in barns, liquid piping networks are provided through which canola oil is sprayed periodically. The release of an additional cupful of liquid from each sprinkler head is undesirable in such applications as it gets on the animals and creates puddles on the floor. The problem can be solved by installing special metering nozzles, but this solution is very costly.

SUMMARY OF THE INVENTION

What is required is a low cost method of stopping leakage from a plurality of sprinkler heads forming part of a liquid piping network.

According to the present invention there is provided a method of stopping excessive leakage from a plurality of sprinkler heads forming part of a liquid piping network. Firstly, providing a backflow inducer housing divided by a liquid retaining flexible diaphragm into a first compartment on a first side of the diaphragm and a second compartment on a second side of the diaphragm. The relative volume of the first compartment and the second compartment change with the positioning of the diaphragm. The first compartment has a first inlet/outlet whereby fluids communicate with the first side of the diaphragm. The second compartment has a second inlet/outlet whereby fluids communicate with the second side of the diaphragm. A spring is provided in the first compartment to bias the diaphragm toward a backflow inducing position in which the volume of the first compartment is larger than the volume of the second compartment. Secondly, connecting the first inlet/outlet of the housing to a liquid piping network having a plurality of sprinkler heads and a source of pressurized liquid, such that liquid in the liquid piping network is in communication with the first side of the diaphragm. Thirdly, connecting the second inlet/outlet of the housing to a source of pressurized working fluid which delivers pressurized working fluid to the second side of the diaphragm. The working fluid is at a pressure sufficient to overcome the biasing force of the spring and the force exerted upon the first side of the diaphragm by the source of pressurized liquid. The diaphragm is moved by the pressurized working fluid toward an operational position in which the volume of the second compartment is larger than the volume of the first compartment. Fourthly, providing control means for the source of pressurized working fluid that causes working fluid to exhaust from the second compartment of the backflow inducer housing simultaneously with a termination of spraying through the sprinkler heads of the liquid piping network. The diaphragm is rapidly moved to the backflow inducing position thereby drawing liquid from the liquid piping network. The housing is of such a size that the movement of the diaphragm from the operational position to the backflow inducing position draws sufficient liquid from the liquid piping network to prevent excessive leakage of the sprinkler heads.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
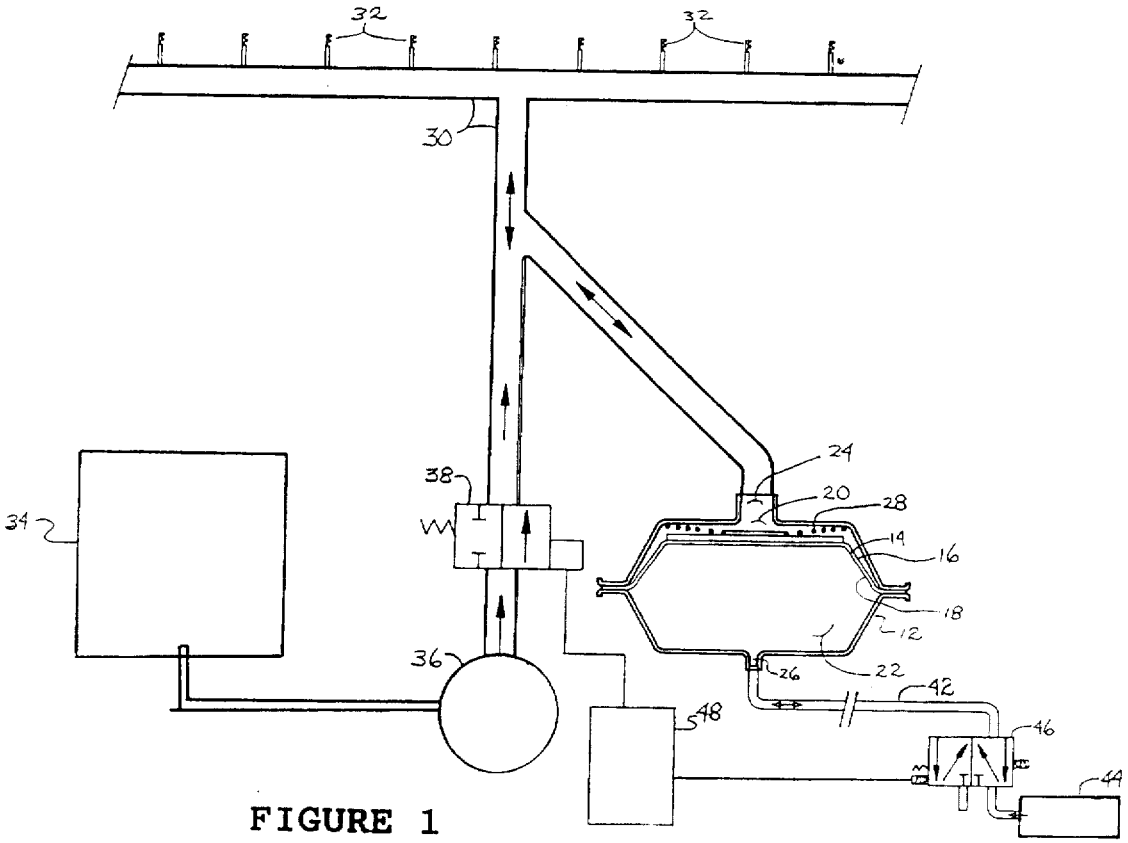
FIG. 1 is a side elevation view, in section, of a liquid piping network constructed in accordance with the teachings of the present invention, with a diaphragm of a backflow inducer housing in an operational position.
Figure 2:
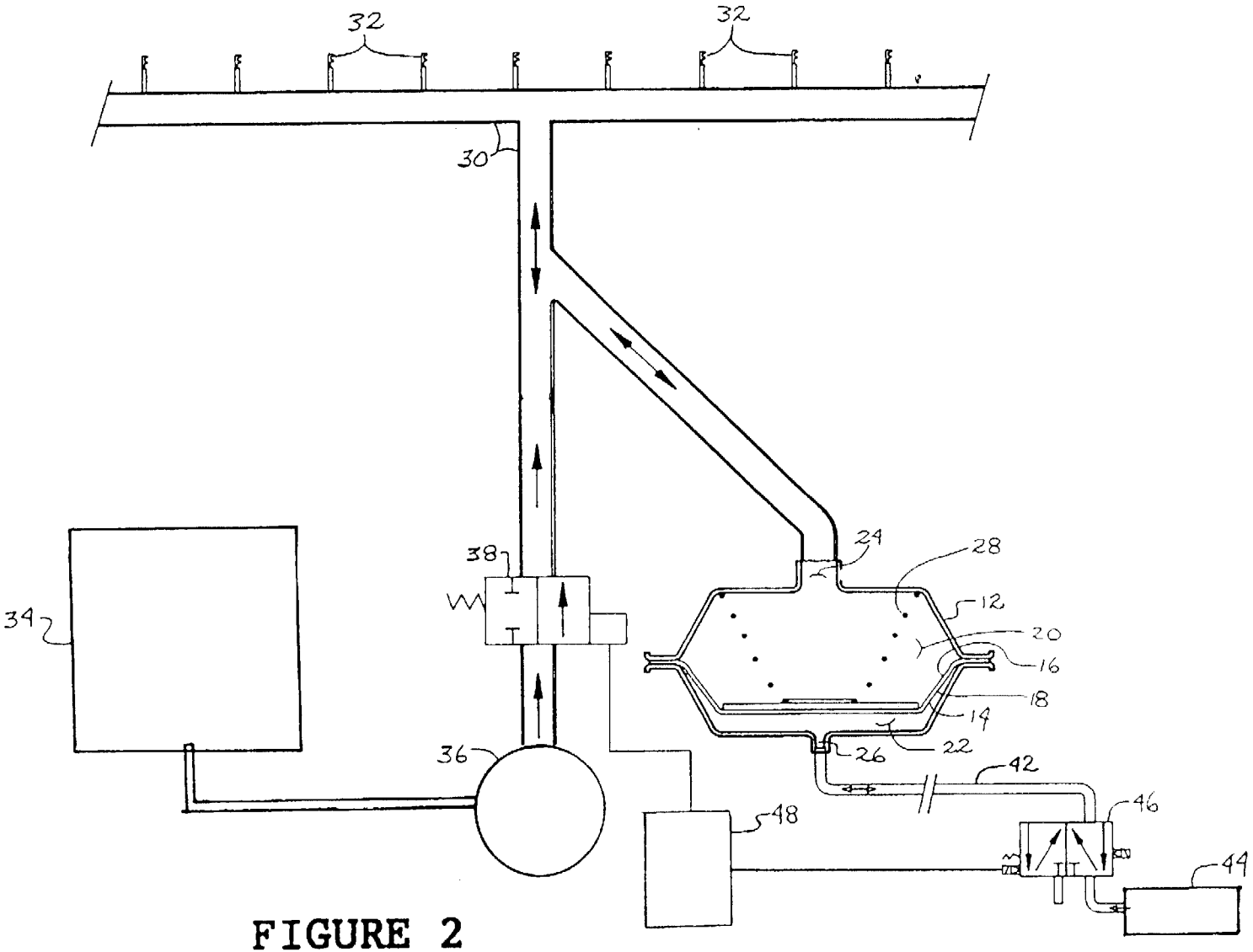
FIG. 2 is a side elevation view, in section, of the liquid piping network illustrated in FIG. 1, with the diaphragm of the backflow inducer housing in a backflow inducing position.

The preferred method of stopping excessive leakage from a plurality of sprinkler heads forming part of a liquid piping network will now be described with reference to FIGS. 1 and 2.

The various components which are combined in accordance with the teaching of the preferred method will first be described. Referring to FIGS. 1 and 2, a backflow inducer housing 12 includes a liquid retaining flexible diaphragm 14. Flexible diaphragm 14 has a first side 16 and a second side 18. Flexible diaphragm 14 divides backflow inducer housing 12 into a first compartment 20 on first side 16 of diaphragm 14 and a second compartment 22 on second side 18 of diaphragm 14. As will be apparent from a comparison of FIG. 1 with FIG. 2, the relative volumes of first compartment 20 and second compartment 22 change with the positioning of diaphragm 14. First compartment 20 has a first inlet/outlet 24 whereby fluids communicate with first side 16 of diaphragm 14. Second compartment 22 has a second inlet/outlet 26 whereby fluids communicate with second side 18 of diaphragm 14. A spring 28 is positioned in first compartment 20. Spring 28 biases diaphragm 14 toward a backflow inducing position, illustrated in FIG. 2, in which the volume of first compartment 20 is larger than the volume of second compartment 22. A liquid piping network 30 is connected to first inlet/outlet 24 of backflow inducer housing 12. Liquid piping network 30 includes a plurality of sprinkler heads 32 and a source of pressurized liquid. In this case, the liquid is canola oil drawn from a tank 34 and pumped under pressure by a pump 36. Liquid piping network 30 also has a control valve 38. A source of pressurized working fluid is connected via a flow line 42 to second inlet/outlet 26 of backflow inducer housing 12. In this case, the source of pressurized working fluid is an air pump 44 and the working fluid is compressed air. Pump 44 is capable of delivering compressed air to second side 18 of diaphragm 14 at a pressure sufficient to overcome the biasing force of spring 28 and the force exerted upon first side 16 of diaphragm 14 by canola oil pump 36. A control valve 46 is provided on flow line 42. A computer controller 48 is provided which controls control valve 38 leading from canola oil pump 36 to liquid piping network 30 and also controls control valve 46 leading from air pump 44 to second compartment 22 of backflow inducer housing 12.

The preferred method of stopping excessive leakage from a plurality of sprinkler heads forming part of a liquid piping network will now be described with reference to FIGS. 1 and 2. Firstly, providing a backflow inducer housing 12, substantially as described above. Secondly, connecting first inlet/outlet 24 of backflow inducer housing 12 to liquid piping network 30. Thirdly, connecting second inlet/outlet 26 of backflow inducer housing 12 to a source of pressurized working fluid, such as air pump 44. Referring to FIG. 1, flexible diaphragm 14 is moved by compressed air supplied by air pump 44 toward an operational position in which the volume of second compartment 22 is larger than the volume of first compartment 20. In doing this, the pressure provided by the compressed air overcomes both the biasing force of spring 28 and the force exerted upon first side 16 of diaphragm 14 by canola oil pump 36. Fourthly, providing computer controller 48 which shuts off air pump 44 and places control valve 46 into an exhaust mode, simultaneously with a termination of spraying of canola oil through sprinkler heads 32 of liquid piping network 30. Computer controller 48 terminates the operation of canola oil pump 36 and closes control valve 38 to prevent further canola oil from entering liquid piping network 30. When control valve 46 is in the exhaust mode, air pressure is released. With the release of air pressure acting upon second side 18 of flexible diaphragm 14, flexible diaphragm rapidly moves to the backflow inducing position illustrated in FIG. 2. This rapid movement draws liquid from liquid piping network 30 into second compartment 22 and, more importantly, drafts liquid from sprinkler heads 32 into liquid piping network 30. A backflow inducer housing 12 is selected that is of such a size that the movement of flexible diaphragm 14 from the operational position to the backflow inducing position draws sufficient liquid from sprinkler heads 32 to prevent excessive leakage. Preferably, the size is sufficient to prevent any leakage from sprinkler heads 32.

It will be apparent to one skilled in the art that modifications may be made to the illustrated embodiment without departing from the spirit and scope of the invention as hereinafter defined in the Claims. In particular, it will be apparent that backflow inducer housing 12 may be located at different positions along liquid piping network 30, depending upon the requirements of a particular installation. For example, in some installations there may be advantages in placing backflow inducer housing 12 at a remote end of liquid piping network 30.

The embodiments of the invention in which an exclusive property or privilege is claimed are defined as follows:

1. A method of stopping excessive leakage from a plurality of sprinkler heads forming part of a liquid piping network, comprising the steps of:

firstly, providing a backflow inducer housing divided by a liquid retaining flexible diaphragm into a first compartment on a first side of the diaphragm and a second compartment on a second side of the diaphragm, the relative volume of the first compartment and the second compartment changing with the positioning of the diaphragm, the first compartment having a first inlet/outlet whereby fluids communicate with the first side of the diaphragm and the second compartment having a second inlet/outlet whereby fluids communicate with the second side of the diaphragm, a spring being provided in the first compartment to bias the diaphragm toward a backflow inducing position in which the volume of the first compartment is larger than the volume of the second compartment;

secondly, connecting the first inlet/outlet of the housing to a liquid piping network having a plurality of sprinkler heads and a source of pressurized liquid, such that liquid in the liquid piping network is in communication with the first side of the diaphragm;

thirdly, connecting the second inlet/outlet of the housing to a source of pressurized working fluid which delivers pressurized working fluid to the second side of the diaphragm at a pressure sufficient to overcome the biasing force of the spring and the force exerted upon the first side of the diaphragm by the source of pressurized liquid, such that the diaphragm is moved by the pressurized working fluid toward an operational position in which the volume of the second compartment is larger than the volume of the first compartment; and fourthly, providing control means for the source of pressurized working fluid that causes working fluid to exhaust from the second compartment of the backflow inducer housing simultaneously with a termination of spraying through the sprinkler heads of the liquid piping network, such that the diaphragm is rapidly moved to the backflow inducing position thereby drawing liquid from the liquid piping network, the housing being of such a size that the movement of the diaphragm from the operational position to the backflow inducing position draws sufficient liquid from the liquid piping network to prevent excessive leakage of the sprinkler heads.

2. An apparatus for stopping excessive leakage from a plurality of sprinkler heads forming part of a liquid piping network comprising:

a backflow inducer housing divided by a liquid retaining flexible diaphragm into a first compartment on a first side of the diaphragm and a second compartment on a second side of the diaphragm, the relative volume of the first compartment and the second compartment changing with the positioning of the diaphragm, the first compartment having a first inlet/outlet whereby fluids communicate with the first side of the diaphragm and the second compartment having a second inlet/outlet whereby fluids communicate with the second side of the diaphragm, a spring being provided in the first compartment to bias the diaphragm toward a backflow inducing position in which the volume of the first compartment is larger than the volume of the second compartment;

a liquid piping network connected to the first inlet/outlet of the backflow inducer housing, the liquid piping network including a plurality of sprinkler heads and a source of pressurized liquid;

a source of pressurized working fluid connected to the second inlet/outlet of the backflow inducer housing, the source of pressurized working fluid being capable of delivering pressurized working fluid to the second side of the diaphragm at a pressure sufficient to overcome the biasing force of the spring and the force exerted upon the first side of the diaphragm by the source of pressurized liquid and move the diaphragm toward an operational position in which the volume of the second compartment is larger than the volume of the first compartment; and control means for the source of pressurized working fluid that causes working fluid to exhaust from the second compartment of the backflow inducer housing simultaneously with a termination of spraying through the sprinkler heads of the liquid piping network, such that the diaphragm rapidly moves to the backflow inducing position thereby drawing liquid from the liquid piping network, the housing being of such a size that the movement of the diaphragm from the operational position to the backflow inducing position draws sufficient liquid from the liquid piping network to prevent excessive leakage of the sprinkler heads.

* * * * *